US006439696B1

(12) United States Patent
Murakami et al.

(10) Patent No.: US 6,439,696 B1
(45) Date of Patent: Aug. 27, 2002

(54) INK JET PRINTING APPARATUS, INK JET PRINTING METHOD AND INK JET PRINT HEAD WITH CONTROL OF DRIVE VOLTAGE AND PULSE WIDTH

(75) Inventors: Shuichi Murakami, Kawasaki; Hiroshi Tajika, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/685,741

(22) Filed: Oct. 11, 2000

(30) Foreign Application Priority Data

Oct. 12, 1999 (JP) ..... 11-290270

(51) Int. Cl.[7] ..... B41J 2/05; B41J 29/38
(52) U.S. Cl. ..... 347/56; 347/57; 347/10
(58) Field of Search ..... 347/15, 57–59, 347/48, 10, 11, 9

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/47 |
| 4,463,359 A | | 7/1984 | Ayata et al. | 347/56 |
| 4,513,298 A | * | 4/1985 | Scheu | 347/64 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,483,265 A | * | 1/1996 | Kneezel et al. | 347/14 |
| 5,751,302 A | | 5/1998 | Rezanka | 347/9 |

FOREIGN PATENT DOCUMENTS

| | | | |
|---|---|---|---|
| EP | 437062 A2 * | 12/1990 | 347/15 |
| EP | 0 650 837 | 5/1995 | |
| EP | 0 818 086 | 1/1998 | |
| EP | 0 936 070 | 8/1999 | |
| JP | 54-56847 | 5/1979 | B41M/5/26 |
| JP | 55-132259 | 10/1980 | B41J/3/04 |
| JP | 60-71260 | 4/1985 | B41J/3/04 |

OTHER PUBLICATIONS

Patent Abstracts of Japan, vol. 017, No. 352 (M–1439), Jul. 5, 1993 (JP 05 050612 A, Mar. 2, 1993).

Patent Abstracts of Japan, vol. 011, No. 102 (M–576), Mar. 31, 1987 (JP 61 249763 A, Nov. 6, 1986).

Patent Abstracts of Japan, vol. 1995, No. 11, Dec. 26, 1995 (JP 07 195692 A, Aug. 1, 1995).

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet printing apparatus capable of forming a high quality multivalued image without using a plurality of print heads and suited for a size reduction is provided. In an ink jet printing apparatus in which the electrothermal transducers are heated by a drive pulse to generate bubbles in ink and in which the pressure of the bubbles is used to eject ink droplets from nozzles onto a print medium to print an image, the drive voltage and the drive pulse width for the print head are changed simultaneously in accordance with print data. For example, when ejecting small droplets, the drive voltage for the nozzles is increased and the drive pulse width shortened. When ejecting large droplets, the drive voltage is lowered and the drive pulse width elongated.

17 Claims, 8 Drawing Sheets

| | REFILL FREQUENCY (kHz) | | |
|---|---|---|---|
| EJECTION AMOUNT (p1) | CONVENTIONAL EXAMPLE 1 | CONVENTIONAL EXAMPLE 2 | EMBODIMENT 5 |
| 10 | 10 | 1.1 | 13.1 |
| 4 | 22.5 | 21 | 16.9 |
| REFILL FREQUENCY RATIO (4p1:10p1) | 2.25 | 1.91 | 1.29 |

FIG.9

| PULSE WIDTH(ms) | Vth(v) | k VALUE | Vop(v) |
|---|---|---|---|
| 0.50 | 12.0 | 1.25 | 15.0 |
| 3.00 | 4.8 | 1.25 | 6.0 |

INK JET PRINTING APPARATUS, INK JET PRINTING METHOD AND INK JET PRINT HEAD WITH CONTROL OF DRIVE VOLTAGE AND PULSE WIDTH

This application is based on Japanese Patent Application No. 11-290270 (1999) filed Oct. 12, 1999, the content of which is incorporated hereinto by reference.

BACKGROUND OF THE INVENTION

1. Field of the Invention

The present invention relates to an ink jet printing apparatus that prints on a print medium and more specifically to an ink jet printing apparatus capable of changing the amount of ink to be ejected.

2. Description of the Related Art

With the widespread use of office automation equipment such as personal computers and word processors in recent years, the use of printing apparatus, the peripheral devices of the equipment, is also spreading quickly. Among the printing systems of the printing apparatus there are a wire-dot system, a heat transfer system, and an ink jet system. These printing systems have their own print heads that perform a predetermined printing on a print sheet being fed.

There are growing demands on these printing apparatus for faster printing speed, higher resolution, higher image quality and lower noise. With the speeds of MPU's increasing and the integration levels of semiconductor memories becoming higher in recent years, the occasion of handling image data has increased. Hence, demands are increasingly growing for a high quality printing of images with half tone.

Among the methods for representing a halftone in the ink jet printing apparatus are a method which controls the number of dots applied to a unit area of a print medium (a pseudo halftone representation using binary values) and a method which uses a plurality of print heads with different ink ejection amounts or with different densities of ink and selects and activates an appropriate head according to a halftone to be printed.

However, there are the following problems with the conventional halftone representation methods.

With the pseudo halftone representation method using binary values, because a single pixel is represented with a plurality of dots, the resolution is degraded.

With the method of representing a halftone by using a plurality of heads with different ink ejection amounts or with different ink densities, the size reduction and space reduction are hindered, with additional problem of an increased cost. In a multivalued full color printing apparatus, in particular, it is necessary to use a plurality of heads for each color, making the realization of this halftone representation method very difficult.

Japanese Patent Application Laying-Open No. 55-132259 (1980) proposes a method which provides two electrothermal transducers (of the same or different sizes) in each nozzle to change a dot size and thereby realize a wide grayscale range and a high image quality with a very simple construction. This constitutes a very important technology in performing a multivalued printing. Provision of a plurality of electrothermal transducers in each nozzle, however, requires setting the nozzle size relatively large, giving rise to a problem that the resolution cannot be enhanced easily.

In the method that provides a plurality of electrothermal transducers in each nozzle and ejects different amounts of ink from each nozzle, the ejection speed is higher when the amount of ink ejected is large than when it is small. This causes variations in the ejection speed, which in turn causes deviations in the dot landing positions, resulting in a disturbed printed image.

It is also proposed that, to eject a small amount of ink a bubble produced by the activation of the electrothermal transducer is not brought into communication with an external air and that only when a large amount of ink is to be ejected, is the bubble brought into communication with an external air. For that purpose, a method has been proposed and implemented which gives one drive pulse for the ejection of one droplet when a small amount of ink is to be ejected and which gives a plurality of pulses for the ejection of one droplet when a large amount of ink is to be ejected. In this case, too, the above-described problem occurs, i.e., the ejection speed is higher when a large amount of ink is ejected than when a small amount is ejected, causing variations in the ink ejection speed and therefore deviations in the dot landing positions, which in turn disturbs an image.

In both of the above two methods, when the ink ejection amount is changed to form a large dot, followed by a small one, a large one, a large one, a small one, and so on for each pixel, meniscus vibrations occur, which in turn causes positional deviations of the meniscus in the nozzle portion. When the meniscus is tilted due to the positional deviation, the dot landing precision deteriorates significantly. Variations in the ink ejection amount should be kept to within ±10% but depending on driving conditions they are found to be as large as about ±20%. In the construction in which a plurality of electrothermal transducers are provided in each nozzle, if it is assumed that the nozzle that ejects a large ink droplet has twice the ink ejection amount of a nozzle that ejects a small ink droplet, the refill frequency of the large droplet ejecting nozzle is reduced to one-half that of the small droplet ejecting nozzle. The print speed of the ink jet printing apparatus therefore is limited by the refill frequency for the large droplet ejecting nozzle, making it impossible to obtain a sufficiently fast print speed.

SUMMARY OF THE INVENTION

The present invention has been accomplished to solve the above-described conventional problems. It is therefore an object of the invention to provide an ink jet printing apparatus and an ink cartridge which can form a multivalued image by changing the ink ejection amount from each nozzle, easily enhance the resolution of the image, reduce ink ejection speed variations and meniscus vibrations when forming large or small dots, and produce high quality images, without using a plurality of electrothermal transducers in each nozzle or a plurality of print heads for ejecting ink droplets of the same color with different densities.

In the first aspect of the present invention, there is provided an ink jet printing apparatus comprising:

a print head having electrothermal transducers in ink ejection nozzles; and drive control means for generating a drive pulse for controlling activation of the electrothermal transducers in accordance with print data;

wherein the drive pulse causes the electrothermal transducers to generate thermal energy to eject ink droplets from the nozzles onto a print medium to print an image;

wherein the drive control means changes a drive voltage and a drive pulse width simultaneously for the print head in accordance with the print data.

In the second aspect of the present invention, there is provided an ink jet printing apparatus comprising:

a print head having electrothermal transducers in ink ejection nozzles; and drive control means for generating a drive pulse for controlling activation of the electrothermal transducers in accordance with print data;

wherein the drive pulse from the drive control means causes the electrothermal transducers to generate thermal energy to eject ink droplets from the nozzles onto a print medium to print an image;

wherein the drive control means, when ejecting small droplets, increases a drive voltage for the nozzles and shortens the drive pulse width for the nozzles and, when ejecting large droplets, reduces the drive voltage and relatively elongates the drive pulse width.

In the third aspect of the present invention, in an ink jet printing method of performing printing an image by utilizing a print head having electrothermal transducers in ink ejection nozzles, generating a drive pulse for controlling activation of the electrothermal transducers, supplying the drive pulse to the electrothermal transducers, and then causing the electrothermal transducers to generate thermal energy to eject ink droplets from the nozzles onto a print medium;

wherein a drive voltage and a drive pulse width for the print head are simultaneously changed in accordance with a print data.

In the fourth aspect of the present invention, in an ink jet printing method of performing printing an image by utilizing a print head having electrothermal transducers in ink ejection nozzles, generating a drive pulse for controlling activation of the electrothermal transducers, supplying the drive pulse to the electrothermal transducers, and then causing the electrothermal transducers to generate thermal energy to eject ink droplets from the nozzles onto a print medium;

wherein when ejecting small droplets, a drive voltage for the electrothermal transducers is increased and a drive pulse width for the electrothermal transducers is shortened; and when ejecting large droplets, the drive voltage is reduced and the drive pulse width is relatively elongated.

In the fifth aspect of the present invention, ink jet print head having a protective film deposited over the electrothermal transducers arranged on a substrate, the protective film being 6,000 Å or less thick.

As described above, in this invention a desired amount of ink can be ejected stably by changing the drive pulse width and the drive voltage. That is, the size of the bubble that changes the amount of ink ejected is determined by the pulse width and the drive voltage of the drive pulse for the electrothermal transducers in the print head. Controlling both of the pulse width and the drive voltage can control the ink ejection in the same head.

For example, when comparison is made between a configuration with a high drive voltage and a short drive pulse width and a configuration with a low drive voltage and a long drive pulse width, the time it takes for the former configuration to transmit heat from the electrothermal transducer to the liquid such as ink is shorter and therefore the amount of ink ejected is smaller than that of the latter configuration. This is because the former configuration has a thinner ink layer (high temperature layer), heated at high temperature, that contributes to a bubble generation.

Hence, to reduce the ink ejection amount, the drive pulse is set to have a higher voltage and a shorter pulse width; and to increase the ink ejection amount, the drive pulse is set to have a lower voltage and a large pulse width. The inventor of this invention measured the size of the bubble formed on the electrothermal transducer and it has been confirmed that the generated bubble is apparently smaller when the drive pulse is set to have a higher voltage and a shorter pulse width. The measurements were made under the condition that the injected energy was constant. That is, the drive voltage was set so that the energy injected into the electrothermal transducer would not change depending on the size of the pulse width. By changing the drive voltage and the drive pulse width simultaneously in this manner, the bubble generating force in the ink jet print head can be controlled, making it possible to change the ink ejection amount by using the same electrothermal transducer.

The bubble generating force is changed by changing the drive voltage and the drive pulse width simultaneously. When a small ink droplet is to be ejected, it is done by keeping the bubble from coming into communication with the external air outside the nozzle. When a large ink droplet is to be ejected, the bubble is communicated with the external air. This can change the ink ejection amount in a wider range.

Further, voltage supply paths for supplying a plurality of different drive voltages are formed in the print head, and the voltage supply paths are disconnected or connected to change the voltage and width of the drive pulse supplied to the electrothermal transducer. This makes it possible to quickly change the drive pulse for the electrothermal transducer, allowing the ink ejection amount to be changed for each pixel.

BRIEF DESCRIPTION OF THE DRAWINGS

FIG. 9 is a table showing a change in the refill frequency with respect to a change in the ink ejection amount;

DETAILED DESCRIPTION OF THE PREFERRED EMBODIMENTS (First Embodiment)

Figure 1:
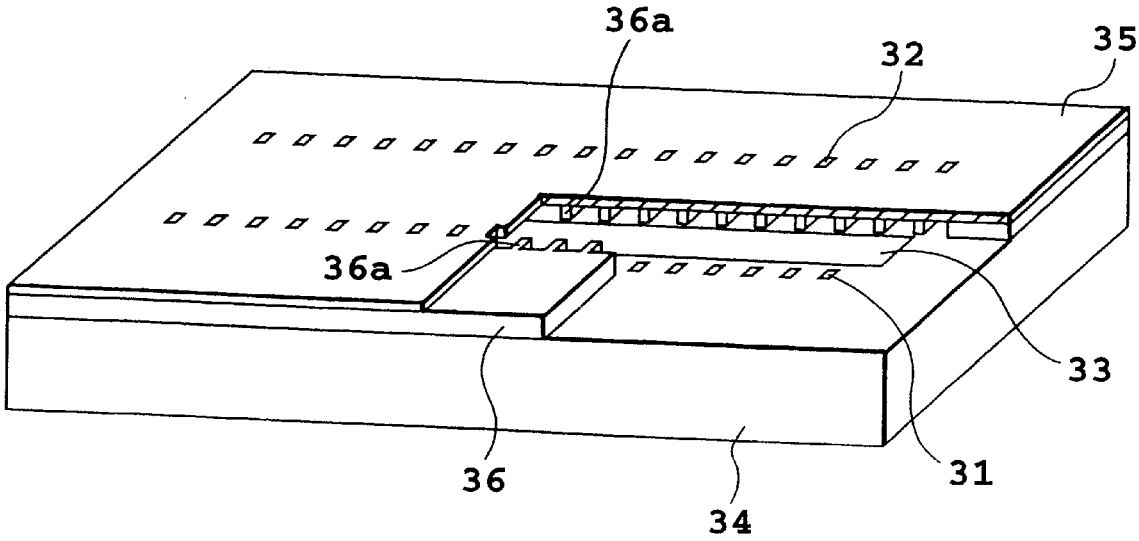
FIG. 1 is a partly cutaway perspective view showing the construction of a print head of the present invention.

FIG. 1 is a schematic perspective view showing a basic construction of the ink jet print head according to a first embodiment of the invention.

FIG. 1 is a perspective view of an ink jet print head board.

In the figure, reference number 34 designates a substrate which functions as part of a flow passage forming member and also as a support member for ink droplet generating elements, ink passages described later and ink nozzles. While in this embodiment we will explain about a case where a silicon substrate is used, the substrate 34 may be formed of glass, ceramics, plastics or metal. The material of the substrate is not essential in this invention and any desired material may be used.

The substrate 34 has two rows of the electrothermal transducers 31, thermal energy generating means, arranged one on each side of the longitudinal length of an ink supply passage 33, an elongate groove, so that the two rows are staggered from each other. The electrothermal transducers 31 in each row are arranged at 300-dpi pitches. Over the substrate 34 is provided a cover resin layer 36 that has ink passage walls 36*a* for forming ink passages. The ink passage walls 36*a* are situated along an edge of an opening formed in the central part of the cover resin layer 36 in such a manner that they are on both sides of each of the electrothermal transducers 31.

The cover resin layer 36 is covered with a nozzle plate 35 that has nozzles 32 situated opposite the electrothermal transducers 31. In FIG. 1 the ink passage walls 36*a* and the nozzle plate 35 are formed of separate members. It is also possible to form the ink passage walls 36*a* on the substrate 34 by spin coating to form the ink passage walls 36*a* and the nozzle plate 35 simultaneously from the same member.

Figure 2:
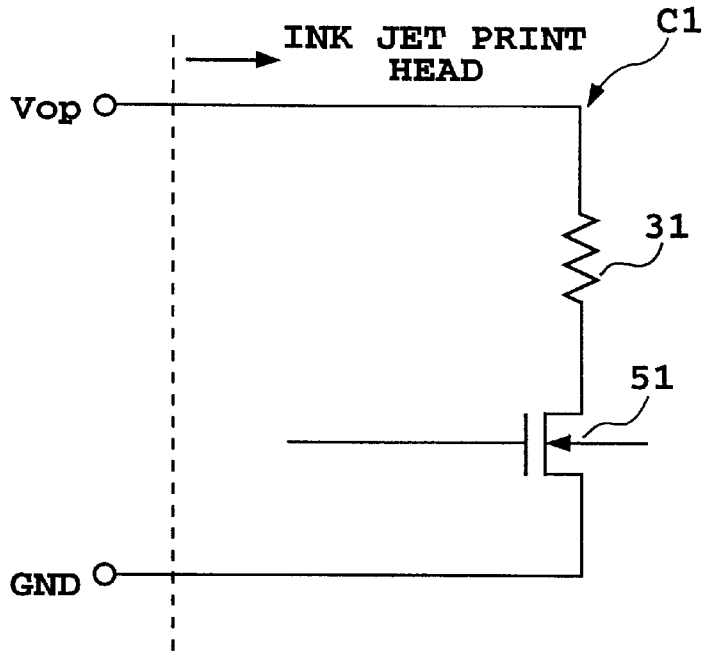
FIG. 2 is a circuit diagram of an example circuit for applying a voltage to a heater in the print head of the invention.

Although electrical wiring for activating the electrothermal transducers is not shown in FIG. 1, a drive voltage supply circuit C1 supplies one drive voltage from the ink jet printing apparatus to the ink jet print head as shown in FIG. 2. The drive voltage supply circuit C1 in this embodiment connects the electrothermal transducer 31, which is connected to a supply voltage terminal Vop, in series with an FET 51, a switching element connected to ground or reference voltage. By turning on the FET 51, the drive voltage from the supply voltage terminal Vop is supplied to the electrothermal transducer 31. Turning off the FET 51 cuts off the supply of the drive voltage to the electrothermal transducer 31. The on-off control of the switching element 51 is performed by a drive signal from a controller incorporating a CPU.

Figure 5A:
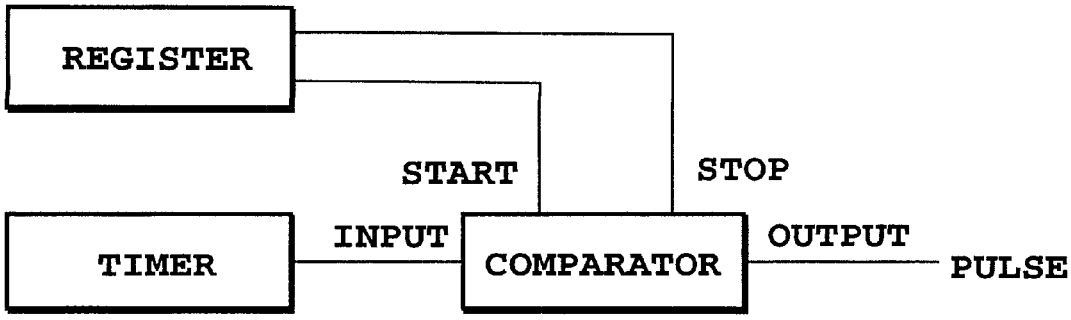
FIG. 5A is a circuit diagram conceptually showing a control circuit for changing the drive pulse width.
Figure 5B:
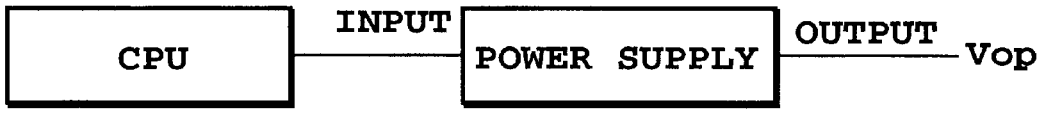
FIG. 5B is a circuit diagram conceptually showing a control circuit of a drive power supply device connected to a supply voltage terminal Vop of the voltage supply circuit of FIG. 2.

The supply voltage terminal Vop is connected to the power supply of the printing apparatus as shown in FIG. 5B, and the power supply is switched between DC6.0V and DC15.0V according to the control signal from the CPU. The pulse width is changed by the register setting the start value and the stop value counted by the comparator, as shown in FIG. 5A. When the Vop and the pulse width are to be changed, the Vop is first changed. When the Vop voltage stabilizes, the start value and the stop value set by the register are changed by software to change the pulse width.

Figure 4A:
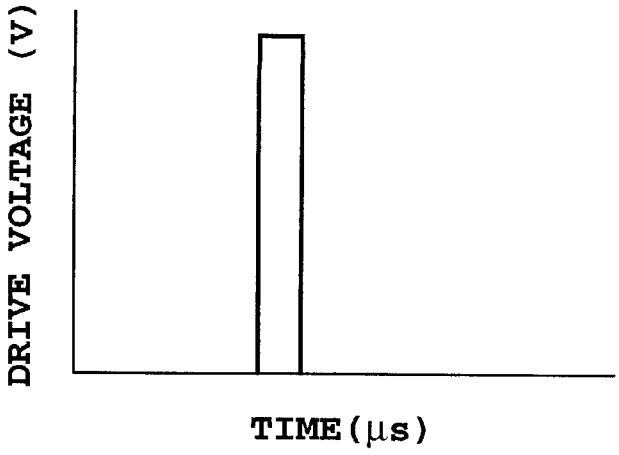
FIG. 4A is a diagram showing a drive pulse to be supplied to the heater of the print head to eject a small amount of ink.
Figure 4B:
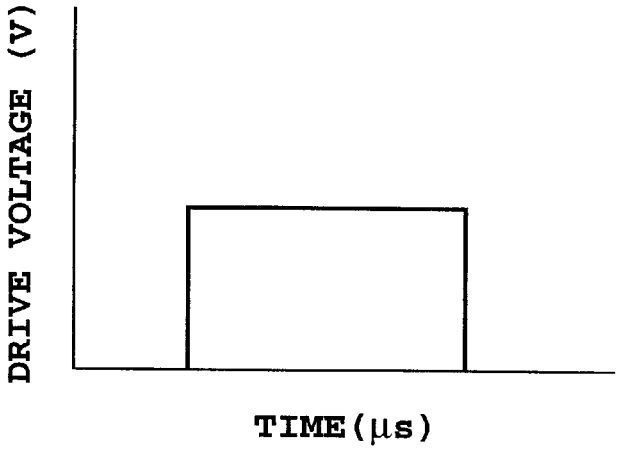
FIG. 4B is a diagram showing a drive pulse to be supplied to the heater of the print head to eject a large amount of ink.
Figure 6:
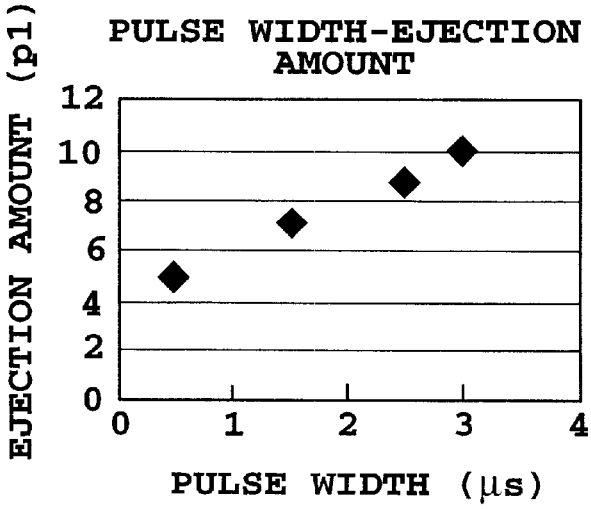
FIG. 6 is a graph showing a relation between a pulse width of the drive pulse and the amount of ink ejected.
Figures 12, 13:
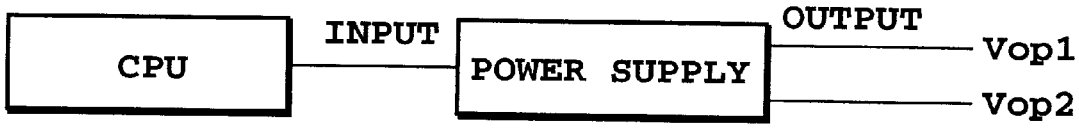
FIG. 12 is a circuit diagram conceptually showing a control circuit of a drive power supply device connected to a supply voltage terminals Vop1, 2 of the voltage supply circuit of FIG. 3.
FIG. 13 is a diagram showing the relation between the drive pulse and the pulse width.

In the first embodiment with the above configuration, the nozzle provided with a single electrothermal transducer can eject different amounts of ink. For example, as shown in FIG. 6, a drive pulse for producing an ejection amount of 5 pl has a drive voltage of 15 V and a drive pulse width of 0.5 $\mu$s, and a drive pulse for producing an ejection amount of 10 pl has a drive voltage of 6 V and a drive pulse width of 3 $\mu$s. Both of these drive pulses have the same k value of 1.25 (the minimum drive voltage at which a bubble is generated in ink). To keep the k value for each drive voltage constant, the Vth for the ink jet print head is determined in advance and data on the relation between the pulse width and the drive voltage is stored in the storage area of the ink jet printing apparatus. The data to be stored is as shown in FIG. 13, which shows the relation between the drive pulse and the pulse width. When actually driving the ink jet print head, the steps involve determining the drive condition for constant k value from the stored data by using the drive device as shown in FIGS. 5A and 5B, and sending a signal to the power supply from the CPU according to the k value to change the Vop. Next, the start and stop values that determine the pulse width and are set by the register are changed through software processing to change the pulse width. By executing the above procedure, the printing can be performed with the driving condition that has the constant k value. The waveforms of these drive pulses are shown in FIG. 4. As shown in the figure, a waveform of FIG. 4A is used to produce the ejection amount of 5 pl and a waveform of FIG. 4B to produce the ejection amount of 10 pl.

Here, let us explain about the value k and how to know the value k.

The ink jet print head has a threshold value of energy which determines whether the ink is ejected or not. That is, unless the energy threshold is exceeded, a bubble is not formed. The parameters that determine the energy applied to the ink jet print head are a voltage and a pulse width. A voltage that determines whether ink is ejected or not is called a threshold voltage Vth, which is determined by changing the voltage while keeping the pulse width constant. When the ink jet print head is activated at this threshold voltage Vth, the drive energy that needs to be applied is larger than the threshold value because the ejection is not stable enough due to surface characteristic of the electrothermal transducer. The drive voltage is set by multiplying the Vth by a certain value, and this certain value is called a k value. That is, the drive voltage=(k value)×Vth.

The process of determining the k value is detailed as follows. With the pulse width applied to the ink jet print head kept constant, the drive voltage is changed during printing. Whether ink droplets are landing on the print medium is checked to determine the threshold drive voltage (Vth). Then, by dividing the drive voltage of the printing apparatus by Vth, the k value to be applied to the ink jet print head can be determined.

In this embodiment, by changing the drive voltage and the drive pulse width, different amounts of ink can be ejected allowing for a grayscale representation. Further, because only one electrothermal transducer is provided in each nozzle, the integration level of the nozzles in the substrate can be set high, facilitating a reduction in the size of the print head.

Figure 4C:
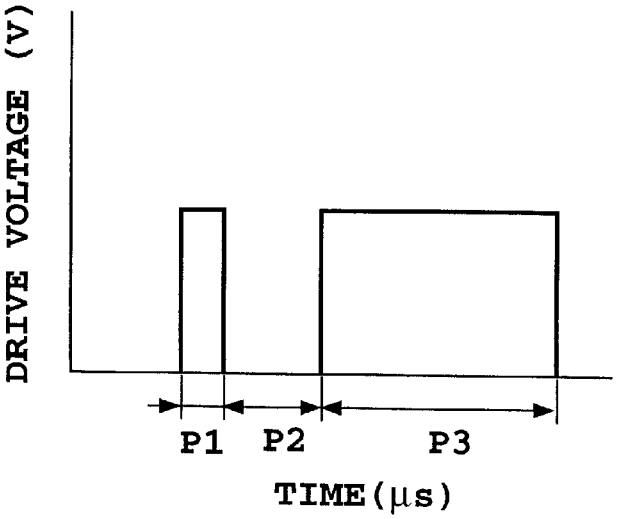
FIG. 4C is a diagram showing a plurality of drive pulses to be supplied to the heater of the print head for a single ejection of ink.

While in this first embodiment we have described the case where the two ink ejection amounts of 5 pl and 10 pl are produced, other ink ejection amounts, for example 8 pl, 10 pl and 15 pl, can also be produced. In addition to the single continuous drive pulse for one ejection operation, it is possible to use a drive pulse made up of a plurality of pulses as shown in FIG. 4C.

Figure 7:
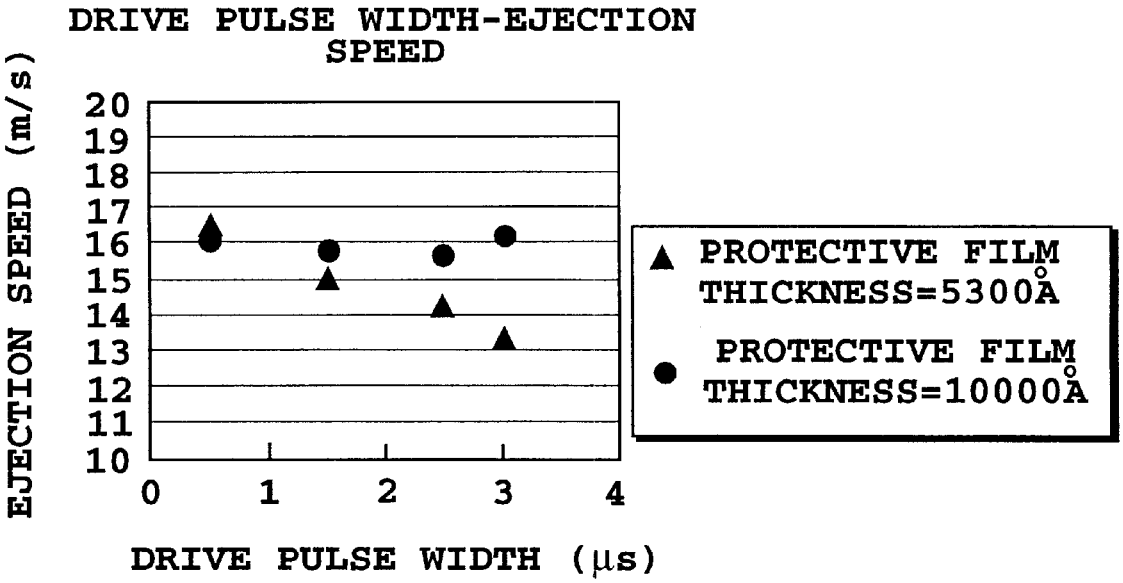
FIG. 7 is a graph showing a relation between the pulse width of the drive pulse and an ink ejection speed.

Further, in this embodiment, the cover resin layer 36 as a protective film over the electrothermal transducers 31 is formed to a thickness of 6,000 Å or less. This is based on the fact that the thinner the layer, the more easily the heat generated by the electrothermal transducer can be conducted to the ink liquid and the more readily the amount of ink ejected can be changed. Further, when the cover resin layer 36 is formed thin, the ink ejection speed with respect to the drive pulse width becomes stabilized, producing a more desirable ejection characteristic. FIG. 7 shows a relation between the drive pulse width and the ejection speed.

When the cover resin layer 36 is 5,300 Å thick, an almost constant ejection speed can be obtained even if the drive pulse width changes. But when the cover resin layer 36 is 10,000 Å thick, the ejection speed decreases as the drive pulse width increases. Any change in the ejection speed makes the control of changing the drive pulse voltage and the drive pulse width simultaneously somewhat difficult. Hence, the cover resin layer 36 is formed thin as described above to realize the ink ejection amount control easily.

(Second Embodiment)

Next, a second embodiment of the invention will be described.

Figure 3:
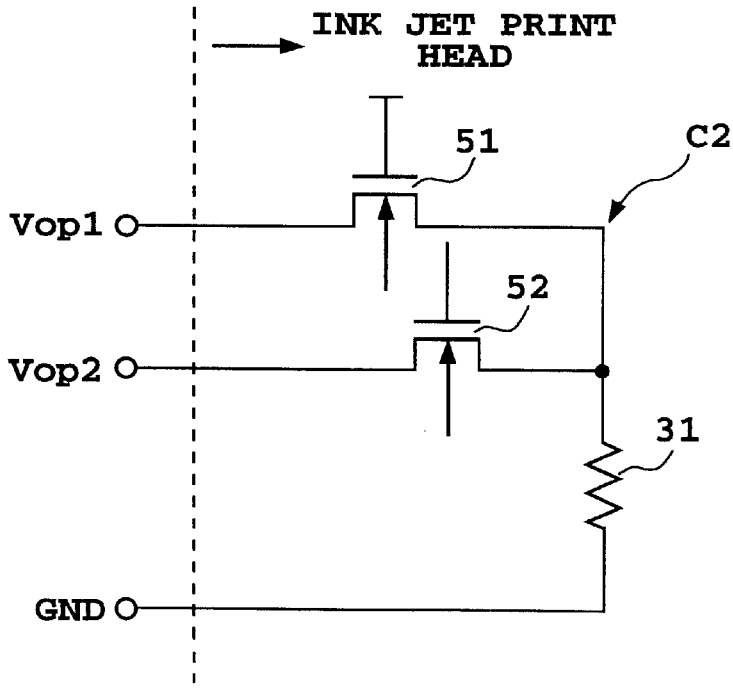
FIG. 3 is a circuit diagram of another example circuit for applying a voltage to the heater in the print head of the invention.

This embodiment has a voltage supply circuit C2 which has two systems of voltage supply paths for supplying two kinds of drive voltages from the ink jet printing apparatus to the ink jet print head, as shown in FIG. 3. That is, the supply voltage terminals Vop1, 2 of the voltage supply circuit C2 are connected to the power supply of the printing apparatus as shown in FIG. 12. The voltage supply circuit C2 comprises two FETs 51, 52 as switching elements connected respectively to two DC supply voltage input terminals Vop1, Vop2, and an electrothermal transducer 31 which is connected at one end to ground GND as a reference voltage and at the other end in series with the two FETs.

In this voltage supply circuit C2, the FET 51 and FET 52 are selectively turned on. When the FET 51 is turned on, the FET 52 is turned off, applying to the electrothermal transducer 31 the voltage that is supplied from the DC voltage supply source not shown to the terminal Vop1. Conversely, when the FET 51 is turned off, the FET 52 is turned on, applying to the electrothermal transducer 31 the voltage supplied to the terminal Vop2.

In this way, the second embodiment has two systems of wiring formed in the substrate of the ink jet print head, allowing the voltages supplied to the respective systems to be selected by the switching operation of the FETs 51, 52. Then, by changing the on-state time of the FETs 51, 52, the drive pulse width can be changed, which in turn changes the ink ejection amount.

In this embodiment one of the terminals Vop1 is supplied with a voltage of 15 V and the other terminal Vop2 is supplied with a voltage of 6 V. To produce an ink ejection amount of 5 pl, the FET 51 is turned on to supply a drive pulse having a voltage of 15 V and a pulse width of 0.5 $\mu$s to the electrothermal transducer. When it is desired to produce an ink ejection amount of 10 pl, the FET 52 is turned on to supply a drive pulse having a voltage of 6 V and pulse width of 3.0 $\mu$s to the electrothermal transducer.

In this second embodiment, too, changing the drive voltage and the drive pulse width can change the amount of ink ejected from the nozzle with a single electrothermal transducer and thereby can express grayscales.

With the ink jet printing apparatus and the ink jet driving method according to the second embodiment, when the drive voltage is to be changed, only the on-off control of the FET 51 or FET 52 of the ink jet print head can change the drive voltage and the drive pulse width simultaneously. This in turn enables the ink ejection amount to be changed quickly for each pixel, realizing highly precise multivalued grayscale representation.

(Third Embodiment)

Next, a third embodiment of the invention will be explained.

In the third embodiment, the ink jet printing apparatus and the print head are similar in construction to those of the first or second embodiment but their driving method is different.

When it is desired to produce an ink ejection amount of 5 pl, a drive pulse having a voltage of 15 V and a pulse width of 0.5 $\mu$s is supplied. When an ink ejection amount of 12 pl is to be produced, a plurality of pulses with 6 V and 0.5 $\mu$s are supplied. In more concrete terms, as shown in FIG. 4C, the drive pulses are set to P1=0.5 $\mu$s, P2=1.0 $\mu$s, and P3=2.5 $\mu$s.

In this way, by applying a plurality of pulses the bubble generating force can be increased to eject a greater amount of ink, further increasing the variety of grayscale representations.

(Fourth Embodiment)

Next, a fourth embodiment of the invention will be described by referring to the drawings.

In this fourth embodiment, the ink jet printing apparatus and the print head have the similar construction to those of the first or second embodiment, but their driving method (ink jet printing method) differs as described below.

The first to third embodiment adopt only the driving method in which the ink is ejected by keeping the bubble generated in the nozzle from communicating with the external air outside the nozzle. The fourth embodiment, on the other hand, can also use a driving method whereby the ink is ejected by allowing the bubble generated in the nozzle to communicate with the external air. By properly switching between the two driving methods—one that allows the bubble to communicate with the external air and one that keeps the bubble from communicating with the external air—the amount of ink ejected is changed. That is, when the bubble generated in the nozzle communicates with the external air, most part of the ink in the bubble generating chamber in the nozzle is ejected. When the bubble is prevented from communicating with the external air, only a part of the ink in the bubble generating chamber is ejected, thus reducing the ink ejection amount.

Therefore, when a small ejection amount of 5 pl is to be produced, the drive voltage is set to 15 V and the pulse width to 0.5 $\mu$s to generate a small bubble generating force in order to keep the bubble from communicating with the external air. When a large ejection amount of 12 pl is to be produced, the drive voltage is set to 6 V and the drive pulse width to 3 $\mu$s to generate a large bubble generating force so as to communicate the bubble with the external air. The k values (the drive voltage/the minimum drive voltage required to generate a bubble in ink) in these cases are the same at 1.25. By switching between the two ejection methods—one in which the bubble communicates with the external air and one in which it does not—the amount of ink ejected can be reliably changed with only one electrothermal transducer.

Further, even at the same k value the amount of ink ejected can be changed by simply changing the drive voltage and the drive pulse width without degrading the durability.

Furthermore, the construction of the ejection portion in which the electrothermal transducer is disposed opposite the nozzle is preferred because a change in the bubble generating force generated by the electrothermal transducer directly affects the ink ejection amount.

In this embodiment also, the number of different ejection amounts from which a selection can be made is not limited to only two. The ejection amount can be selected from a greater number of choices, for example, 5 pl, 8 pl, 10 pl and 15 pl.

It should also be noted that this embodiment like the preceding embodiments is not limited to one drive pulse for each ejection but may use a drive pulse comprising a plurality of pulses.

(Fifth Embodiment)

Now, a fifth embodiment of the invention will be described by referring to the drawings.

In the fifth embodiment, like the fourth embodiment, the ejection amount can be changed by switching between the two methods—one that communicates a bubble with the external air and one that keeps a bubble from communicating with the external air. Further, the print head is characterized in that the cover resin layer over the electrothermal transducers is formed to a small thickness of 6,000 Å.

That is, as shown in FIG. 4, when a small ejection amount of 4 pl is to be produced, the drive voltage is set to 15 V and the pulse width to 0.5 $\mu$s to generate a small bubble so that the bubble does not communicate with the external air. When a large ejection amount of 10 pl is to be produced, the drive voltage is set to 6 V and the drive pulse width to 3 $\mu$s to communicate the bubble with the external air. As for the cover resin layer, silicon is deposited over the electrothermal transducers to a thickness of 3,000 Å and tantalum to 2,300 Å to form the cover resin layer with a combined thickness of 5,300 Å.

In this embodiment, the cover resin layer 36 over the electrothermal transducers 31 is formed thin at 6,000 Å or less. This is based, as explained earlier, on the fact that the thinner the layer, the more easily the heat generated by the electrothermal transducer can be conducted to the ink liquid and the more readily the amount of ink ejected can be changed. Further, when the cover resin layer 36 is formed thin, the ink ejection speed with respect to the drive pulse width becomes stabilized, producing a more desirable ejection characteristic. FIG. 7 shows a relation between the drive pulse width and the ejection speed.

When the cover resin layer 36 is 5,300 Å thick, an almost constant ejection speed can be obtained even when the drive pulse width changes. But when the cover resin layer 36 is 10,000 Å thick, the ejection speed decreases as the drive pulse width increases. Any change in the ejection speed causes deviations in the landing position of ink droplets and therefore disturbances in the printed image. To eliminate these deviations, a drive pulse control is needed, which somewhat complicates the control operation. In this fifth embodiment, therefore, the cover resin layer 36 is formed thin as described above to stabilize the ink ejection speed while the drive pulse width changes, thus facilitating the drive pulse control.

Figure 10:
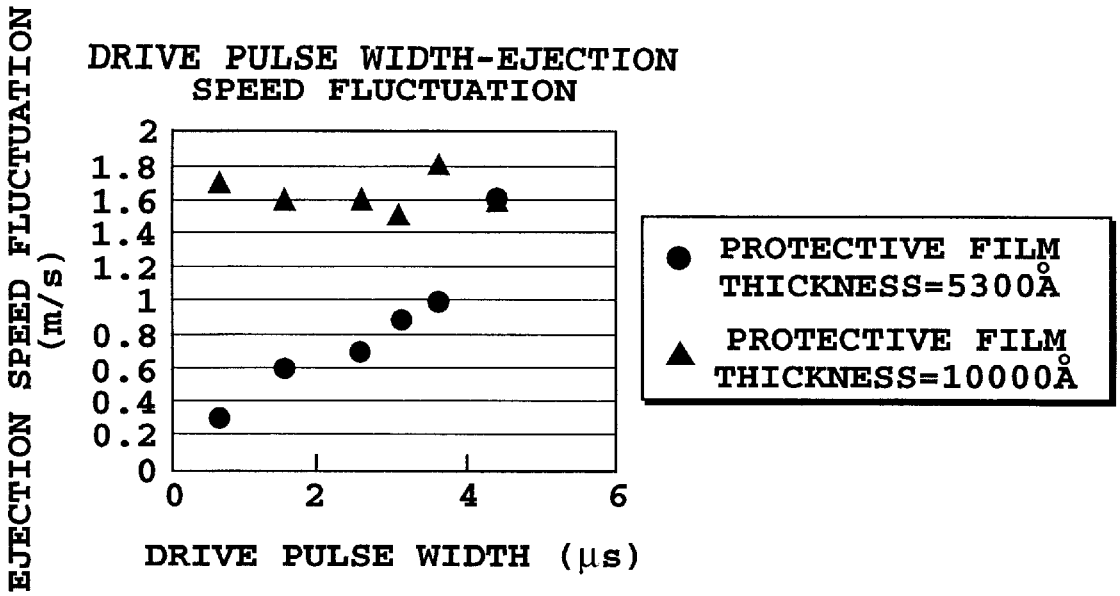
FIG. 10 is a graph showing a relation between the drive pulse width and ink ejection speed fluctuations for two kinds of cover resin layers with different thicknesses.
Figure 11:
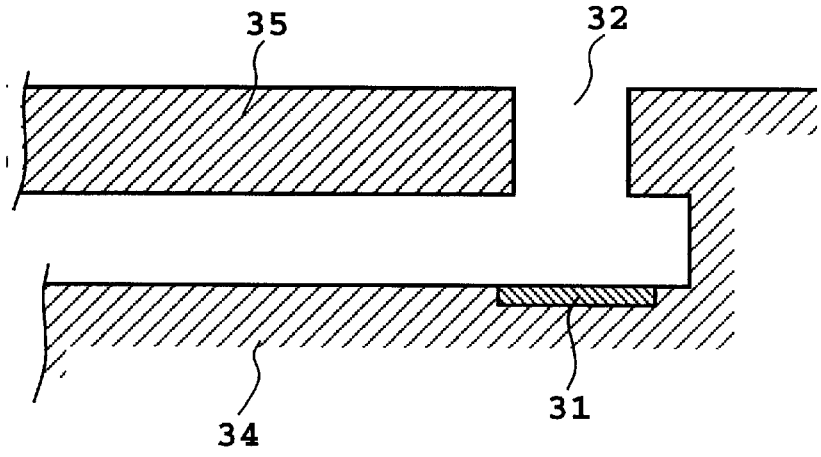
FIG. 11 is a vertical side cross section showing a nozzle portion with an electrothermal transducer disposed opposite a nozzle.

FIG. 10 shows a relation between the drive pulse width and ink ejection speed fluctuations in this embodiment. As shown in FIG. 10, reducing the thickness of the protective film can reduce fluctuations in the ejection speed for each dot. When the pulse width is 4 $\mu$s, though not used in this embodiment, the ejection speed fluctuations become large irrespective of the protection film thickness, causing the dot landing position deviations. Thus, the drive pulse width should be set to less than 4 $\mu$s, more preferably 3.5 $\mu$s or less. Further, when the ejection amount is changed so as to minimize the ejection speed variations, the variations of ejection amount due to meniscus vibrations can also be kept within ±10%.

Figure 8:
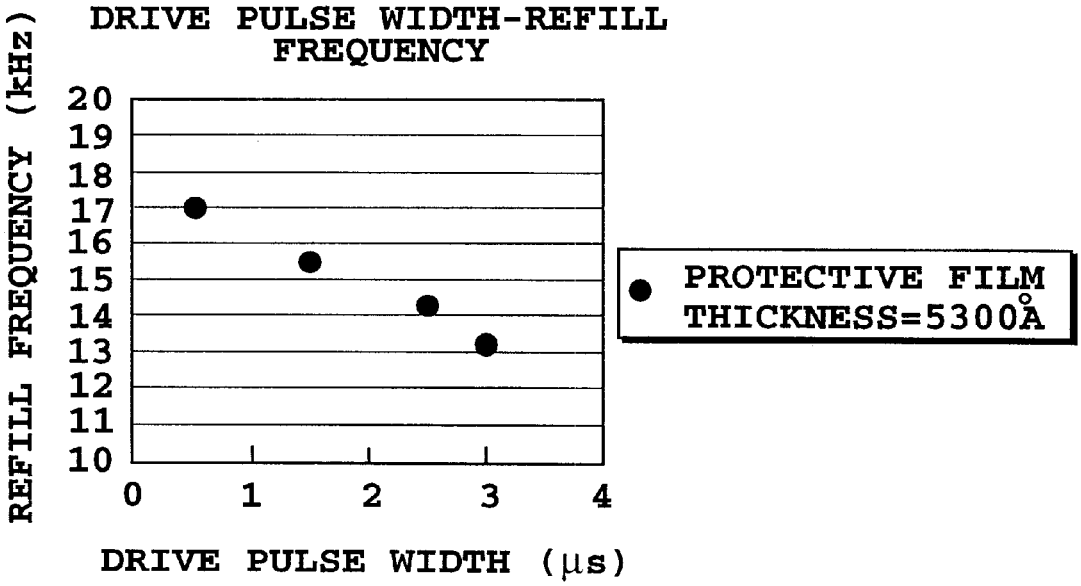
FIG. 8 is a graph showing a relation between the pulse width of the drive pulse and a refill frequency.

Further, in the fifth embodiment the refill 10 frequency for each nozzle can be stabilized even when there are changes in the drive pulse width, i.e., the ink ejection amount. FIGS. 8 and 9 show the relation between the drive pulse width and the refill frequency. As shown in these figures, in the ink jet print head (conventional example 1 of FIG. 9) in which a plurality of heaters are provided in each nozzle, or in the drive method (conventional example 2 of FIG. 9) which switches between a configuration that communicates a bubble with the external air and a configuration that does not, by changing only the pulse waveform at the same drive voltage, the refill frequency decreases by an amount corresponding to a change in the ejection amount caused by the drive pulse. This embodiment, however, offers a significant improvement over the above two conventional examples and minimizes a reduction in the printing speed.

In the conventional example 1 of FIG. 9, when the ejection amount is changed from 4 pl to 10 pl by switching between the drive heaters, the refill frequency exhibits a large drop from 22.5 kHz to 10 kHz (the ratio of the refill frequency for 4 pl to the refill frequency for 10 pl is 2.25), greatly affecting the printing speed. In the conventional example 2, when the ink ejection amount is changed from 4 pl to 10 pl by changing only the drive pulse width, the refill frequency greatly changes from 21 kHz to 1.1 kHz (the ratio of the refill frequency for 4 pl to the refill frequency for 10 pl is 1.91). This greatly affects the printing speed.

In the fifth embodiment, however, even when the ink ejection amount is changed from 4 pl to 10 pl, the refill frequency shows only a small change from 16.9 kHz to 13.1 kHz (the ratio of the refill frequency for 4 pl to that for 10 pl is 1.29), having almost no effect on the printing speed, which remains stable.

While, in the preceding embodiments, we have described the case where only one electrothermal transducer is provided in each nozzle, the present invention can also be applied to where two or more electrothermal transducers are installed in each nozzle, in which case a more varied control of the ink ejection amount can be performed.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. This system is suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As explained above, according to this invention, not only is the drive pulse width changed but the drive voltage is also changed at the same time. Hence, even when only one electrothermal transducer is provided in each nozzle, the bubble generating force can be controlled to change the ink ejection amount and thereby form an image in grayscale.

Therefore, nozzles can be incorporated in the print head with high integration level, reducing the size of the print head, minimizing an increase in the number of electrothermal transducers and reducing cost.

Further, because, under a low bubble generating force condition, a switching is made, as required, between a configuration in which the bubble is communicated with the external air to eject ink and a configuration in which the bubble is not communicated with the external air, it is possible to increase the range in which the ejection amount can be changed.

Voltage supply paths connected to voltage supply sources that supply a plurality of different drive voltages are formed in the print head and are cut off and connected in order to change the voltage and width of the drive pulse supplied to the electrothermal transducers. This allows the drive pulse to the electrothermal transducers to be changed swiftly, making it possible to change the ink ejection amount for each pixel and thereby form a highly defined image.

Further, by keeping the protective film 6,000 Å or less thick, the ink ejection speed can be made constant regardless of the amount of ink ejected and at the same time the refill frequency can be kept from decreasing even when the changed ejection amount increases, thereby shortening the printing time.

Furthermore, by keeping the drive pulse width less than 4 $\mu$s, the fluctuations of the ejection speed a can be reduced for each dot, thus preventing disturbances in the printed image due to deviations in the ink droplet landing positions.

The present invention is not limited to the embodiments in the foregoing, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus comprising:

a print head having electrothermal transducers in ink ejection nozzles; and drive control means for generating a drive pulse for controlling activation of said electrothermal transducers in accordance with print data, wherein said drive pulse from said drive control means causes said electrothermal transducers to generate thermal energy to eject ink droplets from said nozzles onto a print medium to print an image, and wherein said drive control means, when ejecting small droplets, relatively increases a drive voltage for said nozzles and relatively shortens a drive pulse width for said nozzles and, when ejecting large droplets, relatively reduces said drive voltage and relatively elongates said drive pulse width.

2. An ink jet printing apparatus as claimed in claim 1, wherein said drive control means, when ejecting small droplets, increases said drive voltage for said electrothermal transducers and shortens said drive pulse width for said electrothermal transducers in order to keep bubbles generated in ink from communicating with the external air outside the nozzles and, when ejecting large droplets, reduces said drive voltage and elongates said drive pulse width in order to communicate the bubbles generated in ink with the external air.

3. An ink jet printing apparatus as claimed in claim 1, wherein said drive control means outputs a plurality of pulses as the drive pulse for each of the ink ejection operations.

4. An ink jet printing apparatus as claimed in claim 1, wherein the drive control means controls the drive voltage and the drive pulse width while leaving constant a ratio of the drive voltage to a minimum drive voltage required to generate a bubble in ink.

5. An ink jet printing apparatus as claimed in claim 1, wherein said print head has a protective film deposited over said electrothermal transducers arranged on a substrate, and said protective film is 6,000 A or less thick.

6. An ink jet print head as claimed in claim 5, wherein a plurality of wires are provided for supplying a plurality of supply voltages output from voltage supply sources to said print head.

7. An ink jet printing apparatus as claimed in claim 1, wherein said drive control means outputs as the drive pulse a drive pulse with a pulse width of 4 $\mu$s or less.

8. An ink jet printing apparatus as claimed in claim 1, wherein said print head has a structure in which nozzles and said electrothermal transducers face each other.

9. An ink jet printing apparatus comprising:

a print head having electrothermal transducers in ink ejection nozzles; and drive control means for generating a drive pulse for controlling activation of said electrothermal transducers in accordance with print data, wherein the drive pulse causes said electrothermal transducers to generate thermal energy to eject ink droplets from said nozzles onto a print medium to print an image, wherein said drive control means changes a drive voltage and a drive pulse width simultaneously for said print head in accordance with the print data, and wherein the print head is formed with voltage supply paths connected to voltage supply sources for supplying a plurality of different drive voltages, and the drive voltage and the drive pulse width for said electrothermal transducers are changed by controlling the disconnection and connection of the voltage supply paths.

10. An ink jet printing method of performing printing an image by utilizing a print head having electrothermal transducers in ink ejection nozzles, said method comprising the steps of:

generating a drive pulse for controlling activation of the electrothermal transducers;

supplying the drive pulse to the electrothermal transducers; and causing the electrothermal transducers to generate thermal energy to eject ink droplets from the nozzles onto a print medium, wherein, when ejecting small droplets, a drive voltage for the electrothermal transducers is relatively increased and a drive pulse width for the electrothermal transducers is relatively shortened and, when ejecting large droplets, the drive voltage is relatively reduced and the drive pulse width is relatively elongated.

11. An ink jet printing method as claimed in claim 10, wherein, when small droplets are to be ejected from the nozzles of said print head, the drive voltage for the electrothermal transducers is increased and the drive pulse width for the electrothermal transducers is shortened in order to keep bubbles generated in ink from communicating with the external air outside the nozzles and, when large droplets are to be ejected, the drive voltage is lowered and the drive pulse width is relatively elongated in order to communicate the bubbles generated in ink with the external air.

12. An ink jet printing method as claimed in claim 10, wherein a plurality of pulses are output as the drive pulse for one ink ejection operation of each nozzle in the print head.

13. An ink jet printing method as claimed in claim 10, wherein the print head has a protective film deposited over the electrothermal transducers arranged on a substrate, and the protective film is 6,000 Å or less thick.

14. An ink jet printing method as claimed in claim 10, wherein the drive control means outputs as the drive pulse a drive pulse with a pulse width of 4 $\mu$s or less.

15. An ink jet printing method as claimed in claim 10, wherein the drive control means controls the drive voltage and the drive pulse width while leaving constant a ratio of the drive voltage to a minimum drive voltage required to generate a bubble in ink.

16. An ink jet printing method as claimed in claim 10, wherein the print head has a structure in which the nozzles and the electrothermal transducers face each other.

17. An ink jet printing method of performing printing an image by utilizing a print head having electrothermal transducers in ink ejection nozzles, said method comprising the steps of:

generating a drive pulse for controlling activation of the electrothermal transducers;

supplying the drive pulse to the electrothermal transducers; and causing the electrothermal transducers to generate thermal energy to eject ink droplets from the nozzles onto a print medium, wherein a drive voltage and a drive pulse width for the print head are simultaneously changed in accordance with print data, and wherein the print head is formed with voltage supply paths connected to voltage supply sources for supplying a plurality of different drive voltages, and the drive voltage and the drive pulse width for the electrothermal transducers are changed by controlling the disconnection and connection of the voltage supply paths.

* * * * *

UNITED STATES PATENT AND TRADEMARK OFFICE

CERTIFICATE OF CORRECTION

PATENT NO. : 6,439,696 B1
DATED : August 27, 2002
INVENTOR(S) : Shuichi Murakami et al.

It is certified that error appears in the above-identified patent and that said Letters Patent is hereby corrected as shown below:

Column 10,
Line 7, "10" should be deleted.

Column 11,
Line 18, "consists" should read -- consist --.

Column 13,
Line 33, "6000 A" should read -- 6000 Å --; and
Line 64, "an" should read -- of an --.

Column 14,
Line 44, "an" should read -- of an --.

Signed and Sealed this

Sixteenth Day of September, 2003

JAMES E. ROGAN
*Director of the United States Patent and Trademark Office*